US006388614B2

(12) United States Patent
Radonic

(10) Patent No.: US 6,388,614 B2
(45) Date of Patent: May 14, 2002

(54) ANTENNA APERTURE COVER FOR ANTENNA POINTING AN IMPROVED ANTENNA POINTING METHOD USING APERTURE COVER

(75) Inventor: Nick Radonic, Gaithersburg, MD (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/852,459

(22) Filed: May 10, 2001

Related U.S. Application Data

(60) Provisional application No. 60/216,099, filed on Jul. 6, 2000.

(51) Int. Cl.[7] ..... H01Q 3/00

(52) U.S. Cl. ..... 342/359

(58) Field of Search ..... 342/359

(56) References Cited

U.S. PATENT DOCUMENTS 5,903,237 A * 5/1999 Crosby et al. ..... 342/359
6,208,315 B1 * 3/2001 Kenmochi ..... 342/359

* cited by examiner

*Primary Examiner*—Thomas H. Tarcza
*Assistant Examiner*—Fred H Mull
(74) *Attorney, Agent, or Firm*—John T. Whelan; Michael W. Sales

(57) ABSTRACT

An improved apparatus and method for pointing a satellite dish to receive signals from a geo-synchronous satellite. An aperture cover is used to partially block electromagnetic radiation provide to a feed horn and power and/or signal quality measurements are taken with the aperture cover covering various portions of the feed horn opening. Based on these power and/or signal quality measurements, it is determined in what direction and what angle in that direction the satellite dish must be re-oriented to achieve optimal signal strength from a geo-synchronous satellite or other fixed position microwave source.

23 Claims, 5 Drawing Sheets

ANTENNA APERTURE COVER FOR ANTENNA POINTING AN IMPROVED ANTENNA POINTING METHOD USING APERTURE COVER

The present invention claims benefit under 35 U.S.C. 119(e) of a U.S. provisional application of Nick Radonic entitled "Antenna Aperture Cover for Antenna Pointing and Improved Antenna Pointing Method Using Aperture Cover", Ser. No. 60/216,099, filed Jul. 6, 2000, the entire content of which is incorporated herein by reference.

BACKGROUND OF THE INVENTION

1. Field of the Invention

The present invention relates to a method and apparatus that provides more accurate and time efficient antenna pointing for a satellite receiver antenna dish. More particularly, the present invention relates to an aperture cover that is placed over an opening of a feed horn to block some of the radiation coming into the feed horn such that the amount of power coming into the feed horn can be controllably varied and measured to determine the error angle and direction through which the satellite dish needs to be turned to achieve optimum reception from a geo-synchronous satellite. This invention is applicable for use with other fixed location microwave sources.

2. Description of the Related Art

Conventional methods of pointing a satellite receiver antenna dish to optimally receive signals from a geo-synchronous satellite involve monitoring received signal strength as the satellite dish is turned on its mount and estimating the optimum pointing from the changes in the signal strength meter reading. This is also known as 'peaking' the signal. For example, the satellite receiver antenna assembly can provide a feedback voltage from the receiver to be measured with a voltmeter or other signal strength indicator device. The signal strength indicator presents the power received by the antenna feed and is used to show the receive signal strength. In existing satellite receiver/transmitter embodiments, the value of the signal strength falls as the dish is pointed toward the source and rises as it is moved away from the signal source and past the direction of optimum signal strength. These single datum methods do not indicate the direction to which the antenna dish should be pointed to achieve optimum signal strength, nor what angle the antenna dish must be turned in order to achieve optimum signal strength. Thus, trial and error is required in conventional systems to point a satellite dish so as to achieve maximum signal strength from a geo-synchronous satellite. In addition, existing systems for pointing satellite antennas are not likely to achieve the stringent pointing tolerances (e.g., <0.2 degrees) that can be required for a broadband, multimedia satellite communication system with terminals employing a small antenna size.

A need therefore exists for a method and an apparatus that provides fast and accurate pointing of a satellite dish to achieve optimum reception from a geo-synchronous satellite.

SUMMARY OF THE INVENTION

It is therefore an object of the present invention to provide a method and an apparatus that efficiently and accurately point a satellite receiver antenna dish to optimally receive signals from a geo-synchronous satellite.

It is also an object of the present invention to provide a method and apparatus that enable a user to quickly determine the direction and the angle the antenna dish must be turned in order to receive the optimum signal strength from a geo-synchronous satellite.

It is a further object of the present invention to find the pointing direction in two dimensions for optimum reception using a two-step approach whereby the dish is displaced in a first direction (e.g., azimuth) based on a first set of measurements, and then displaced in a second direction orthogonal to the first direction (e.g., altitude) based on a second set of measurements to receive optimum signal strength.

It is yet another object of the present invention to find the two dimensional pointing correction for optimum reception using a one-step approach whereby only one larger set of measurements is taken to adjust the antenna dish to receive optimum signal strength from a geo-synchronous satellite both with respect to azimuth and altitude.

These and other objects are substantially achieved by providing an aperture cover that is configured to be removable and is attached to a collar on the feed horn of a satellite antenna receiver to partially cover the feed horn opening and therefore to partially block radiation from entering the feed horn. The aperture cover can be adjusted to cover any fraction of the feed horn opening to partially block different amounts of radiation from entering the feed horn. In one embodiment, two sets of measurements are taken and two dish movements are used to determine the optimum pointing angle of the satellite receiver antenna dish. The first set of measurements is started with the aperture cover covering one side of the feed horn opening and then is completed by rotating the aperture cover to the opposite side of the feed horn opening. The differences in these signal strength measurements determine how far and in which direction the dish should be turned. The same process is repeated in a direction orthogonal to the first set of measurements and the dish is then moved in the orthogonal direction to achieve optimum reception. This embodiment can be used on systems with circular or rectangular feed horn openings.

A second embodiment of the present invention is useful for antennas with feed horns having circular openings. A reference power measurement is first made with no aperture cover blocking the feed horn. Then, at least three measurements are taken of power received by the feed horn with the aperture cover partially covering the opening of the feed horn at equally spaced angular intervals. Between each of these measurements, the aperture cover and collar are rotated with respect to the feed horn opening by an angle of 360 degrees divided by the number of measurements taken. From these measurements, an error vector is determined to allow a single adjustment to achieve optimum power reception to a geo-synchronous satellite or fixed microwave source. The angle of the error vector is a mathematical average of the complex coordinates of data angle and signal quality measurements collected in the second embodiment. The magnitude of the error vector is proportional to the range of signal quality estimates in the data collected in the second embodiment.

BRIEF DESCRIPTION OF THE DRAWINGS

These and other objects, advantages and novel features of the invention will be more readily appreciated from the following detailed description when read in conjunction with the accompanying drawings, in which.

DETAILED DESCRIPTION OF THE PREFERRED EMBODIMENTS

Figure 1:
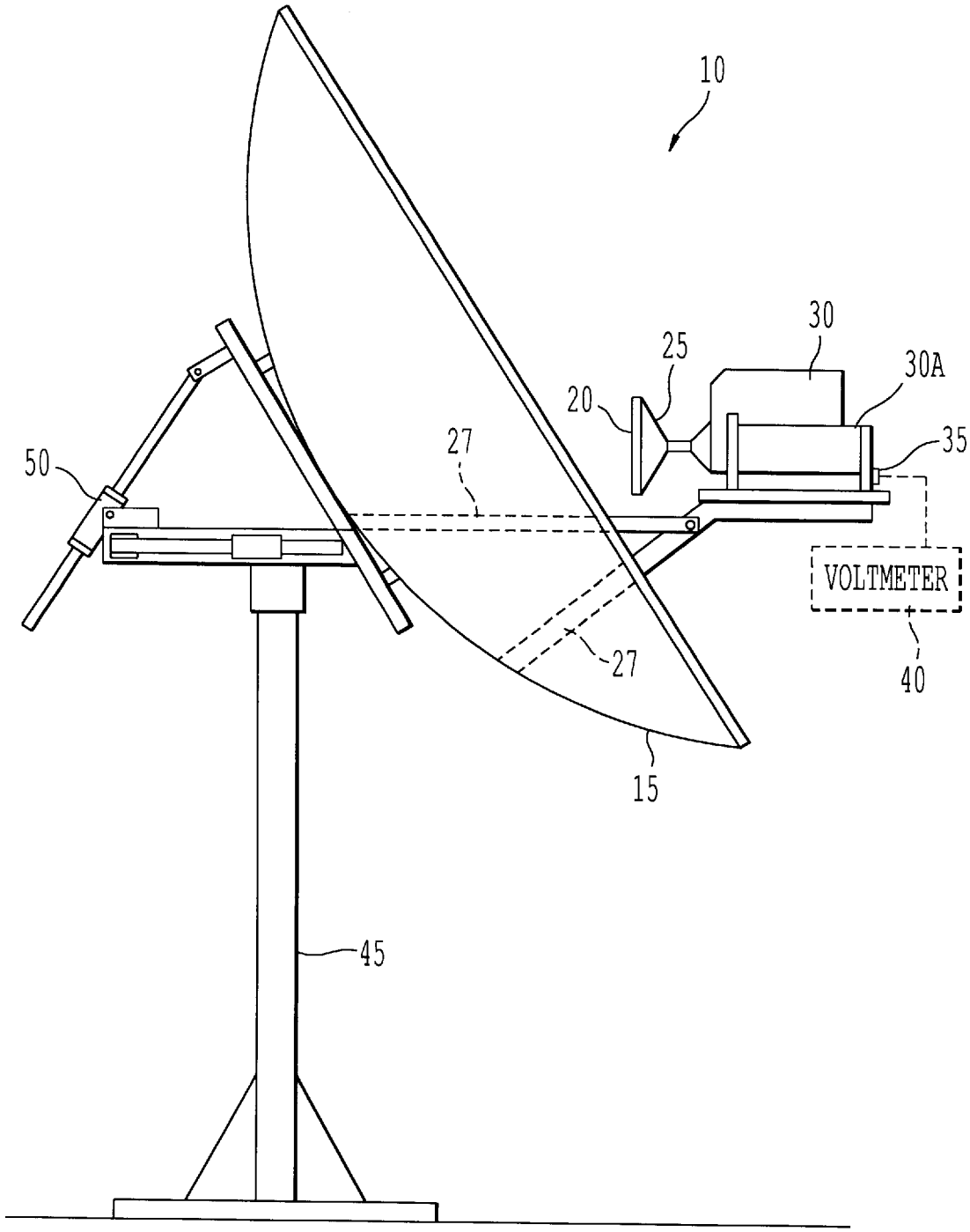
FIG. 1 is a side view of a satellite receiver antenna dish with an antenna pointing device constructed according to an embodiment of the present invention.

FIG. 1 is a side view of a conventional satellite receiver antenna assembly 10. As will be described below, an aperture cover is used in accordance with the present invention to efficiently achieve optimum pointing direction. The antenna assembly 10 comprises a dish 15 that is used to both reflect and focus electromagnetic signals received from a geo-synchronous satellite into an opening 20 of a feed horn 25. The dish 15 can be any of a number of shapes, such as circular or rectangular. The dish 15 shown in FIG. 1 is circular for illustrative purposes. The feed horn opening 20 is circular in FIG. 1, but can be rectangular or another shape to correspond with the shape of the dish.

With continued reference to FIG. 1, signals provided to the feed horn 25 are processed by a low noise block radio frequency detector 30. The feed horn 25 and the low noise block radio frequency converter 30 and microwave power amplifier 30A are attached to the dish 15 via one or more struts 27. The microwave power amplifier 30A is also provided with one or more auxiliary electrical connectors. One of these electrical connectors 35 provides an output voltage or current that in this embodiment of the present satellite receiver is inversely proportional to the power and/or signal quality received by the opening 20 of the feed horn 25 from a geo-synchronous satellite. A measurement and/or computing device 40 such as a voltmeter can be electrically connected to the electrical connector 35 to provide a digital output indicating signal level. As described in more detail below, the measurement and/or computing devices facilitate the determination of which direction and what angle the antenna dish 15 must be moved in order to achieve optimum signal strength from a geo-synchronous satellite in accordance with the present invention.

As shown in FIG. 1, a mounting device 45 is used to elevate the antenna dish 15, feed horn 25, and low noise block radio frequency detector 30, and microwave amplifier 30A assembly above the ground. A conventional dish movement mechanism 50 attaches the mount 45 to the satellite dish 15 (e.g., by a plurality of bolts) and is used to adjust the pointing direction of the antenna dish 15. The illustrated dish movement mechanism 50 employs two adjustment mechanisms. For example, one adjustment mechanism can adjust the antenna dish 15 in the azimuth direction and the other adjustment mechanism can adjust the antenna dish in the altitude direction orthogonal to the azimuth direction. It is to be understood that the dish movement mechanism 50 can employ other mechanisms to achieve antenna dish pointing.

Figure 2:
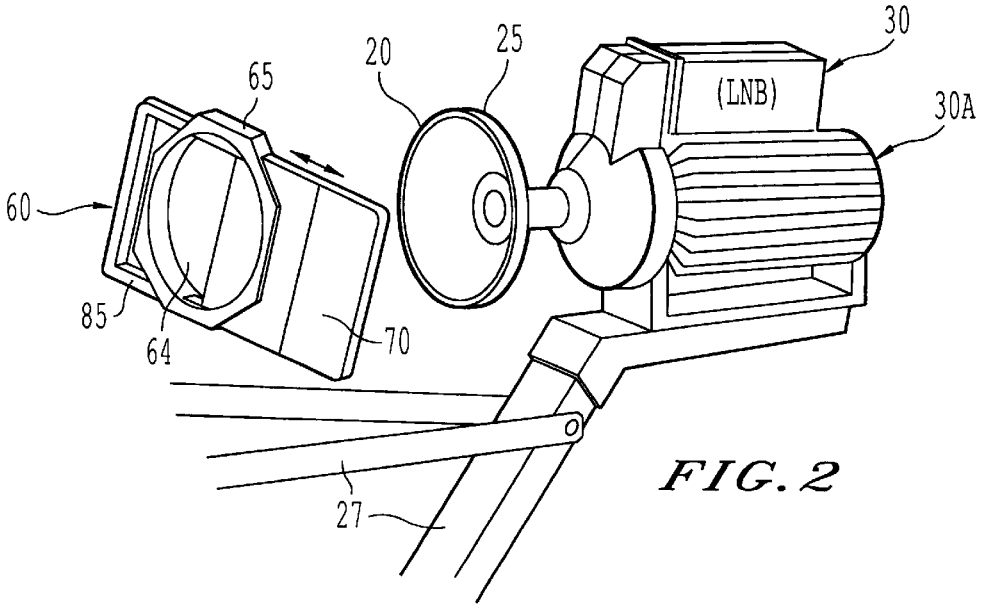
FIG. 2 is an isometric view of a feed horn having a circular opening and a circular aperture cover constructed in accordance with an embodiment of the present invention.

FIG. 2 depicts the feed horn 25, the low noise block radio frequency detector 30, and microwave amplifier 30A shown in FIG. 1 together with an aperture cover 60 constructed in accordance with an embodiment of the present invention. The aperture cover 60 has a circular collar 65 that is removably mounted over the feed horn opening 20 in a conventional manner. For example, the collar 65 can be dimensioned to engage the opening of the feed horn with mechanical friction. Alternatively, the collar can be provided with adjustable mounting means such as an adjustable strap and clamp mechanism to engage the outer perimeter of the feed horn opening. The collar 65 fits on the feed horn opening 20 so that the aperture cover 60 can rotate with respect to the feed horn 25 and the low noise block radio frequency detector 30. A frame 85 comprising a sliding shield 70 is affixed to the collar 65. The shield 70 can be adjusted relative to the frame to cover part of the cross-sectional area 64 outlined by the collar 65 and the feed horn opening 20. The shield 70 is made of a material that does not transmit electromagnetic radiation used in satellite communications to the feed horn, for instance aluminum. The shield 70 operates to block some of the radiation from the dish 15 from entering the feed horn opening 20 when the collar 65 is placed around the feed horn opening 20. Accordingly, less radiation is allowed to enter the low noise block frequency detector 30 than when the aperture cover 60 is completely removed from the feed horn opening 20.

Figure 3:
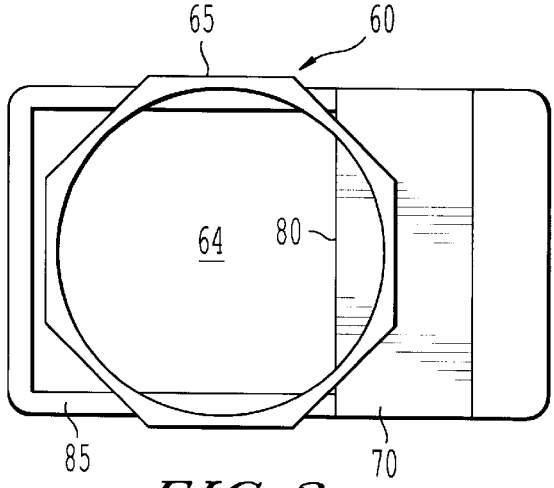
FIGS. 3 and 4 are top views of an aperture cover constructed to fit over a feed horn having a circular opening in accordance with an embodiment of the present invention.
Figure 4:
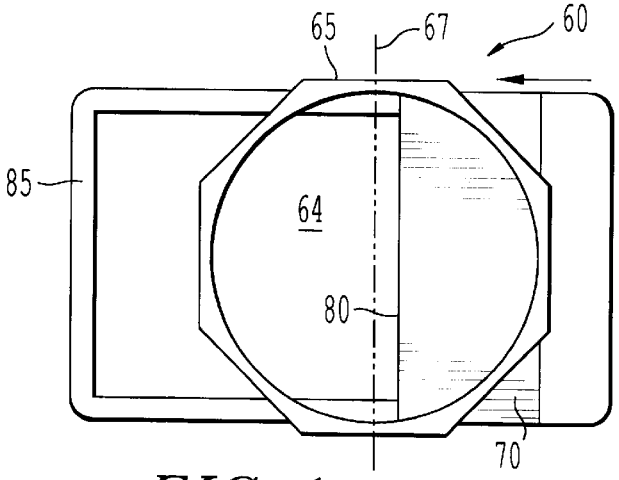

FIGS. 3 and 4 depict the aperture cover 60. As stated previously, the aperture cover 60 comprises a collar 65 which is circular and fits around the exemplary circular feed horn opening 20 illustrated in FIG. 1. The shield 70 is configured to cover a dynamically selected portion of the cross-sectional area 64 of the collar 65. The shield 70 is made out of aluminum or some other material that blocks electromagnetic radiation. The shield 70 is preferably attached to the frame 85 to allow the shield 70 to be adjusted to cover a certain percentage of the cross-sectional area 64 defined by the collar 65. The shield 70 is moved left and right until power received by the feed horn 25 is diminished by a selected amount. The shield 70 preferably covers less than 50% of the total cross-sectional area of the collar 65 when antenna pointing measurements are taken, as indicated by the aperture center reference line 67.

Figure 6:
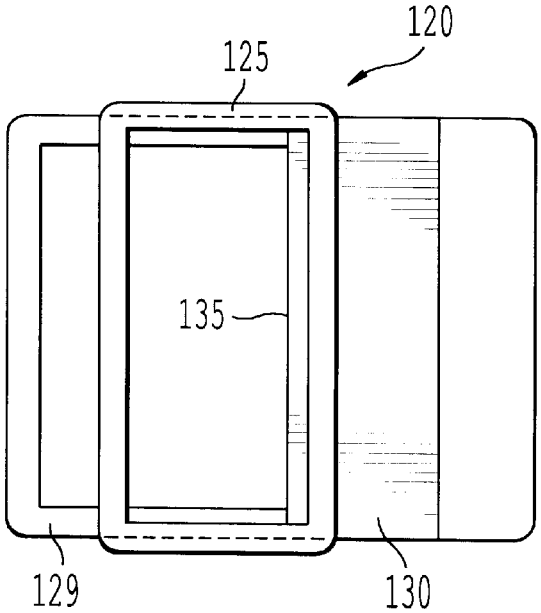
FIGS. 6 and 7 are top views of respective aperture covers having a rectangular collar that fits over the rectangular feed horn of FIG. 5 in accordance with an embodiment of the present invention.
Figure 7:
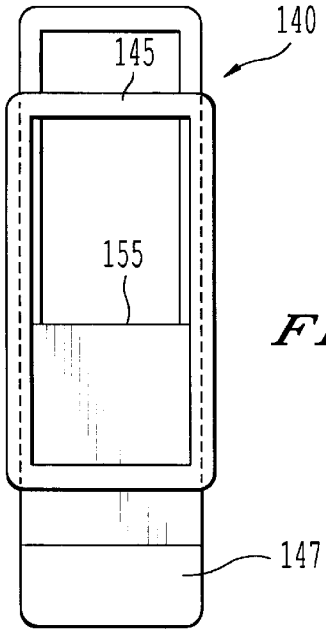
Figure 8:
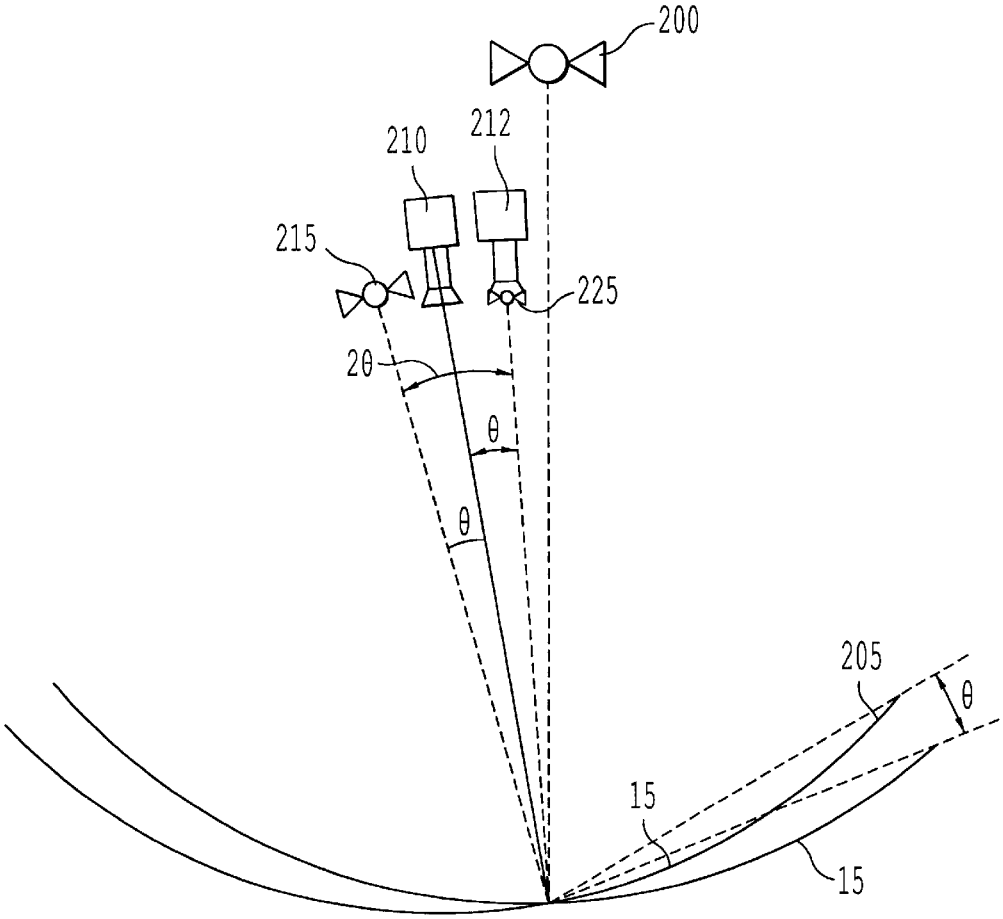
FIG. 8 illustrates dish rotation with respect to a satellite and the location of optimum focus for receiving information from said satellite according to an embodiment of the present invention.

In accordance with the present invention, the aperture cover 60 is used to block radiation from the dish 15 from entering the feed horn opening 20 to degrade the power signal sufficiently for measurement purposes via the measurement and/or computing device 40. A human installer uses the output of the measurement and/or computing device 40 and the known orientation of the aperture cover 60 with respect to the feed horn opening 20 to determine when the measured power signal is most impaired and, correspondingly, the direction of and the amount of dish rotation needed to maximize reception of the electromagnetic energy from the satellite via the feed horn. The dish movement is illustrated in FIG. 8, and described below. FIGS. 6 and 7 illustrate other embodiments of aperture covers and their use for determining the required dish movement for optimal reception.

It is to be understood that the direction and the amount of dish movement can be determined manually by an installer. In other words, an installer can decide the direction and degree of movement based on output readings of the measurement and/or computing device 40 after moving the aperture cover 60 relative to the feed horn opening 20 and the shield 70 relative to the frame 85 of the cover 60. The measurement and/or computing device 40 can also be programmed to make the decisions relating to direction and amount of dish movement based on a programmed set of thresholds of power signal levels and the known orientation of the shield 70 relative to the opening 20. In addition, the dish movement can be automated to respond to the decisions generated by the measurement and/or computing device 40.

With continued reference to FIGS. 3 and 4, the process for pointing the satellite receiver assembly 10 in an optimal direction according to one embodiment of the present invention first involves placing the collar 65 onto the feed horn opening 20 so that an edge 80 of the shield 70 is substantially vertical, for example. The measurement and/or computing device 40 measures the power entering the feed horn opening 20. It is then determined how much of the cross-sectional area of the collar 65 is to be covered by the shield 70 by moving the sheild relative to the frame 85 left and/or right until the power received by the feed horn 25 is diminished by a selected predetermined amount. At this point, a first power measurement is taken. Following the first power measurement, the aperture cover 60 is rotated approximately 180 degrees. A second power measurement is taken of the power received by the feed horn 25. Using the measurement and/or computing device 40, a direction and an angle that the satellite dish 15 is to be moved for optimal reception can be determined to perform the azimuth component of the pointing correction. The measurement and/or computing device 40 can take the form of a look-up table where the difference of power between the two measurements is plotted or tabulated versus angle along one axis that the dish can be moved. The look-up tables are tables that are manufactured during calibration of the satellite dish and feedhorn. The measurement and/or computing device can be programmed so that a direction and angle can be output based on the first and the second power measurements. The movement of the satellite dish can be accomplished either manually or automatically using the dish movement mechanism 50. Manually moving the dish usually involves loosening bolts associated with the dish movement mechanism and rotating the satellite dish the calculated azimuth correction angle by moving some part of the mechanism and then tightening the bolts.

After the first adjustment is made, the aperture cover 60 is rotated 90 degrees so that the edge 80 of the shield 70 is oriented in a horizontal direction. A third measurement is taken of the power entering the feed horn opening 20 by the measurement and/or computing device 40. Following this third measurement, the aperture cover 60 is rotated 180 degrees so that the edge 80 of the shield 70 is again horizontal but inverted. A fourth measurement is made of the power entering the feed horn opening 20. Using the measurement and/or computing device 40, the second direction, altitude, and the second distance in the second direction that the satellite dish 15 is to be adjusted by the dish movement mechanism 50 to achieve optimum signal reception is determined. The dish 15 is then moved in this second direction a second angle by the dish movement mechanism 50, resulting in the satellite dish 15 being pointed in the optimum altitude direction to receive signals from a geo-synchronous satellite.

Figure 9:
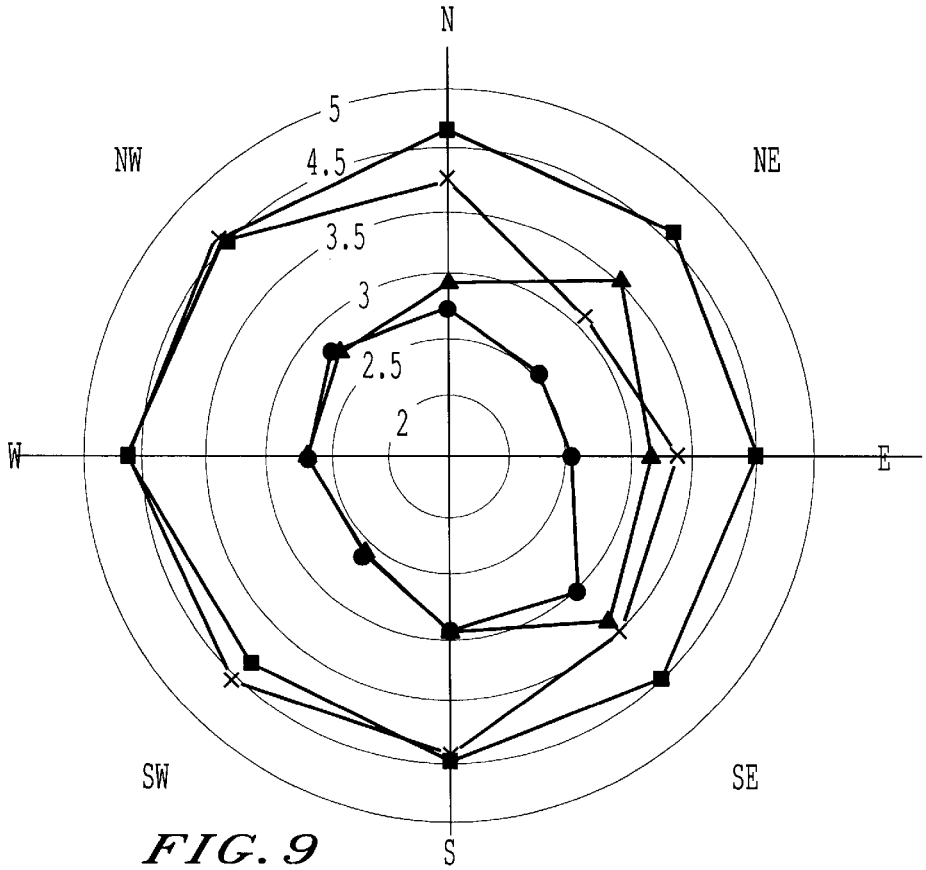
FIG. 9 illustrates a polar chart illustrating data measured according to an embodiment of the present invention.

In accordance with a second embodiment of the present invention, only one set of measurements is needed for the calculation of only one direction and one angle that the satellite dish needs to be turned to achieve optimum reception. Initially, a first measurement of power entering the feed horn opening 20 is made for power level reference. The aperture cover 60 is then placed over the feed horn opening 20 and a second measurement is made. The aperture cover 60 is then rotated one way by 120 degrees and a third measurement is made of the power entering the feed horn opening 20. Finally, the aperture cover 60 is rotated again the same direction as before (i.e., by another 120 degrees) and a fourth power measurement is taken. In accordance with one aspect of the present invention, these four measurements are provided to the measurement and/or computing device 40 which then determines a single direction and a single angle that the satellite dish 15 should be moved in order to achieve optimum reception from a geo-synchronous satellite. The determination of the angle and direction from the power levels of the four measurements is made by plotting the measured data on a graph as illustrated in FIG. 9. By estimating the direction of strongest signal either through plotting a graph of the collected data, or by mathematically averaging the signal quality data for the second, third and fourth points, the direction and the angle in which satellite dish 15 must be moved to achieve optimum reception is determined. After this determination is made, the dish movement mechanism 50 is operated either manually or automatically to point the dish in the determined optimum direction.

Other variations of the second embodiment include first making one power measurement with no aperture cover 60 over the feed horn opening 20 and then making more than three measurements with the aperture cover 60 over the feed horn 20. Between each measurement, the aperture cover 60 is rotated 360 degrees divided by the number of measurements to be made with the aperture cover 60 on the feed horn opening 20. Each time a rotation is made, the aperture cover 60 is preferably rotated the same way. For example, if four measurements were to be made with the aperture cover 60 covering feed horn opening 20, a rotation of 90 degrees is required between each measurement.

Figure 5:
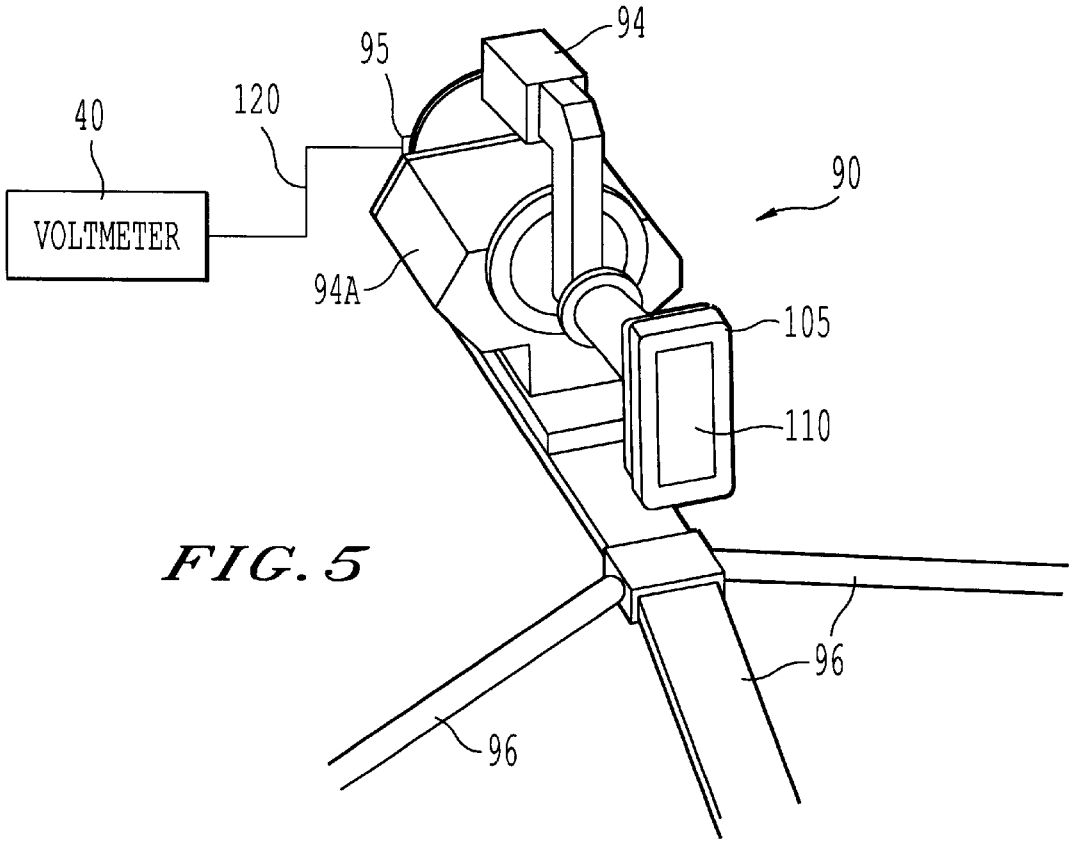
FIG. 5 is an isometric view of a conventional feed horn having a rectangular opening for use with a satellite antenna dish having an essentially rectangular shape.

FIG. 5 illustrates a partial rectangular satellite antenna assembly 90. The rectangular satellite antenna assembly 90 comprises an essentially rectangular satellite dish (not shown), a low noise block radio frequency detector 94, a microwave power amplifier 94A (for transmission), a rectangular feed horn 105 attached to low noise block radio frequency detector 94, a plurality of struts 96 that attach low noise block radio frequency detector 94, a microwave power amplifier 94A, and rectangular feed horn 105 to the rectangular satellite dish, and a mounting device (not shown) that elevates the satellite dish and the low noise block radio frequency detector 94, a microwave power amplifier 94A, and the feed horn 105 above the ground. An electrical connector 95 on the microwave power amplifier 94A provides an output signal that in this embodiment is inversely proportional to power received by the feed horn 105 but can be understood to also operate with a proportional system. A cable 120 is attached to electrical connector 100 and delivers power measurements from the electrical connector 100 to the measurement and/or computing device 40 (not shown). As with the previous embodiments, a voltage, current, or digital readout from the microwave power amplifier 94A is representative of the power received by the feed horn and is used to determine the direction and angle the satellite dish must be moved to achieve optimum reception or to assist an installer in making these decisions.

FIG. 6 illustrates the first aperture cover 120 of two aperture covers that fit over the rectangular feed horn opening 110 for making the first two of four power measurements necessary to point rectangular dish of the assembly 90 in an optimum direction. The aperture cover 120 comprises a collar 125 that is rectangular, and a frame 129 with a sliding shield 130 that can be adjusted to partially block electromagnetic radiation from entering the rectangular feed horn 105. The shield 130 is made of aluminum or some other material that reflects or absorbs electromagnetic radiation. The edge 135 of the shield 130 is preferably in a vertical direction for the first two power measurements. The percentage of electromagnetic radiation that is to be blocked is based on the attenuation of the power being received by the feed horn 105. Generally, the shield 130 is set to block less than 50% of the total cross sectional area defined by the collar 125. The collar 125 fits over the feed horn opening 110 and a first measurement is taken of the power entering the feed horn 105. The aperture cover is then rotated 180 degrees and placed on the feed horn opening 110, and a second power measurement is made. From these two measurements, the measurement and/or computing device 40 facilitates the determination of the first direction and a first angle that the rectangular satellite dish needs to be adjusted for before optimal reception to be achieved.

FIG. 7 illustrates the second aperture cover 140 of the preferably two rectangular aperture covers 140 that are used to make the third and fourth power measurements to point rectangular satellite antenna dish of the assembly 90 in an optimum direction. The aperture cover 140 comprises a collar 145 and a shield 147 slideably attached to a frame 150. An edge 155 of the shield 147 is horizontal for the third and fourth power measurements. The aperture cover 140 and the shield 147 are adjusted so that power entering the feed horn 105 is attenuated by a predetermined percentage. The aperture cover 140 is placed onto the feed horn opening 110 and a third power measurement is made. The aperture cover 140 is then rotated 180 degrees and placed on the feed horn 105. Once again, the edge 155 of the shield 147 is horizontal and a fourth power measurement of power entering the feed horn 105 is made for azimuth angle correction. The measurement and/or computing device 40 facilitates, based on the third and fourth measurements, the determination of a second direction and a second angle that the satellite dish needs to be moved in order to achieve optimum satellite reception. This second direction for altitude correction is orthogonal to the first direction.

FIG. 8 illustrates satellite dish movement (i.e., the top view of the dish 15 is illustrated) with respect to image reception from satellite 200. Originally, before satellite pointing, the dish is in a first position 205, the feed horn is in a first position 210, that is, an angle of $-\Theta$ from the nominal, and the received satellite image is in a first location 215 at angle $-2\Theta$ from the desired direction into the feed horn 210. If satellite dish is rotated by an angle $+\Theta$, the image is moved by $+2\Theta$, resulting in the feed horn being moved to a new second position 212 with the image 225 being substantially centered on the feed horn when dish is moved to its new position 230. This is a simplified version of how satellite pointing can achieve optimum image reception.

FIG. 9 illustrates test data generated according to the second embodiment of the present invention, which is also provided in the following table:

| Aperture cover orientation (rotational angle): | Pointing Voltage (AGC and Eb/N0 feedback) Dish Azimuth Angle: 286.5 | 287.0 | 287.5 | 288.5 | 289.0 |
|---|---|---|---|---|---|
| N | 4.5 | 4.5 | 3.4 | 3.2 | 4.13 |
| NE | 4.5 | 4.5 | 4.1 | 3 | 3.55 |
| E | 9.57 | 4.5 | 3.6 | 3 | 3.8 |
| SE | | 4.5 | 3.8 | 3.5 | 3.9 |
| S | | 4.4 | 3.3 | 3.3 | 4.36 |
| SW | | 4.2 | 3 | 3 | 4.5 |
| W | | 4.5 | 3.1 | 3.1 | 4.5 |
| NW | | 4.4 | 3.25 | 3.26 | 4.5 |
| None (reference) | 4.5 | 4.2 | 3.1 | 3.05 | 3.6 |

Pointing voltage measurements, which are representative of the received power level and/or signal quality, are tabulated for various compass angles of an aperture cover on a satellite feedhorn versus azimuth angles of the satellite dish. In this case, there are nine measurements taken for each test angle. One of the power measurements is taken with the aperture cover off the feed horn, to provide a reference level, and the remaining eight measurements are taken with the aperture cover on the feed horn, resulting in the aperture cover being rotated 45 degrees between each of the eight measurements with the aperture cover mounted on the feed horn. The lowest pointing values, representing the strongest signal levels, are at an azimuth angle for the satellite dish near 288.5 degrees. The data is plotted on a polar coordinate grid in FIG. 9. By observing the shape of the plotted data, the error vector, which represents the sum of the two orthogonal corrections, can be estimated to turn the dish towards the strongest signal to achieve optimum reception from a geosynchronous satellite.

Figure 10:
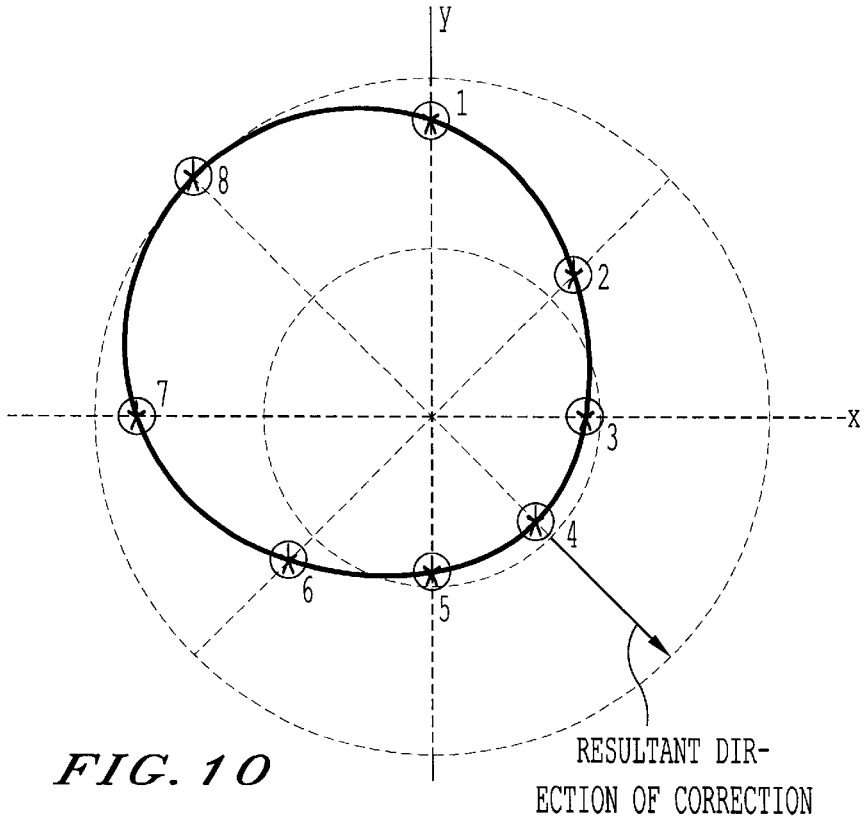
FIG. 10 illustrates a polar chart illustrating how the direction the satellite dish must be moved is determined from the power measurements according to an embodiment of the present invention.

FIG. 10 illustrates a process by which the measurement and/or computing device 40 can determine a direction and an angle the satellite dish must be moved in order to optimize reception. FIG. 10 depicts signal strength versus aperture cover orientation whereby optimum reception corresponds to points closest to the (0,0) x-y coordinate. The amount of correction is estimated from tables or graphs. The following table comprises an example of a set of data that can be measured in a lab for calibration. As illustrated in FIG. 10, eight measurements are taken with an aperture cover placed over the feed horn in accordance with the present invention. Between each measurement in this example, the aperture cover is rotated 45 degrees. From FIG. 10, the direction that the satellite dish must be moved is determined by drawing an arrow from the point of least power reception (point 8) toward the point of greatest reception (point 4). The angle the dish must be moved in this direction is determined from an example table shown below where the power drop of point 4 is tabulated versus the power drop of point 8 as compared to when no aperture is covering the feed horn. This look-up table gives example angles for a variety of power drops based on the maximum measurement with the aperture cover on the feed horn and the minimum measurement with the aperture cover on the feed horn. It is understood that the data is specific to the implementation and that the data in the table will change depending on the calibration or pointing data used. The example table is shown below:

SAMPLE - ANGLE ERROR ESTIMATE FOR MEASURED POWER DIFFERENCES

| HIGHEST | LOWEST SNR | | | | | | |
|---|---|---|---|---|---|---|---|
| SNR | 4 dB | 5 dB | 6 dB | 7 dB | 8 dB | 9 dB | 10 dB |
| 4 dB | 0 | X | X | X | X | X | X |
| 5 dB | 0.1 | 0 | X | X | X | X | X |
| 6 dB | 0.2 | 0.1 | 0 | X | X | X | X |
| 7 dB | 0.3 | 0.2 | 0.1 | 0 | X | X | X |
| 8 dB | 0.4 | 0.3 | 0.2 | 0.1 | 0 | X | X |
| 9 dB | 0.5 | .04 | 0.3 | 0.2 | 0.1 | 0 | X |
| 10 dB | 0.6 | 0.5 | 0.4 | 0.3 | 0.2 | 0.1 | 0 |

While the preferred embodiments have been set forth with a degree of particularity, it is to be understood that changes and modifications could be made to the construction thereof which would still fall within the teachings of the claimed invention as set forth in the following claims.

What is claimed is:

1. A method of pointing a satellite receiver antenna dish to optimize reception, comprising the steps of:

placing an aperture cover over a first portion of an opening of a feed horn to partially cover said opening of said feed horn;

measuring a first signal strength from a geo-synchronous satellite received by said partially covered feed horn;

rotating said aperture cover 180 degrees with respect to said opening to cover a second portion of said opening of said feed horn, said second portion being diametrically opposite to said first portion;

measuring a second signal strength from said geo-synchronous satellite received by said partially covered feed horn;

determining a first angle and a first direction said antenna dish is to be turned to achieve optimum signal strength based on said first signal strength and said second signal strength; and adjusting said satellite antenna dish in said first direction and by said first angle for a correction in azimuth angle.

2. The method of claim 1, further comprising the steps of:

placing an aperture cover over a third portion of said opening of said feed horn different from said first portion and said second portion;

measuring a third signal strength from said geo-synchronous satellite received by said partially covered feed horn;

rotating said aperture cover 180 degrees with respect to said opening to cover a fourth portion of said opening of said feed horn, said fourth portion being diametrically opposite to said third portion;

measuring a fourth signal strength from said geo-synchronous satellite received by said partially covered feed horn;

determining a second angle and a second direction said antenna dish is to be turned to achieve optimum signal strength based on said third signal strength and said fourth signal strength, said second direction being orthogonal to said first direction; and adjusting said antenna dish in said second direction and by said second angle for correction in altitude.

3. The method of claim 2, wherein said aperture cover is attached to a collar that is removably mounted on said feed horn.

4. The method of claim 3, wherein said opening of said feed horn is rectangular.

5. The method of claim 3, wherein said opening of said feed horn is circular.

6. The method of claim 5, wherein said aperture cover comprises a sliding member which moves with respect to said collar allowing said aperture cover to cover any fraction of area of said opening of said feed horn when said collar and said aperture cover are placed over said opening of said feed horn.

7. The method of claim 5, wherein said aperture cover comprises a fixed aperture cover to cover a fixed fraction of area of said opening of said feed horn when said collar and said aperture cover are placed over said opening of said feed horn.

8. The method of claim 5, wherein said steps of placing said aperture cover over said opening of said feed horn and rotating said aperture cover about said feed horn are accomplished manually.

9. A method of pointing a dish of a satellite receiver antenna, comprising the steps of:

measuring a first signal strength from a geo-synchronous satellite received by an unobstructed feed horn;

placing an aperture cover over an opening of said feed horn in a first position to partially cover said feed horn;

measuring a second signal strength from said geo-synchronous satellite received by said partially covered feed horn;

rotating said aperture cover over said opening of said feed horn to a second position;

measuring a third signal strength from said geo-synchronous satellite received by said partially covered feed horn;

rotating said aperture cover over said opening of said feed horn to a third position;

measuring a fourth signal strength from said geo-synchronous satellite received by said partially covered feed horn;

determining a direction and an angle to turn said dish to achieve optimum reception by said feed horn of signals from said geo-synchronous satellite based on said four measurements and said three positions of said aperture cover; and adjusting said dish using said direction and said angle.

10. The method of claim 9, wherein said first position is 120 degrees apart from both said second position and said third position allowing for a 2 dimensional estimate of pointing error with a minimal data set of sample points.

11. The method of claim 9, wherein said aperture cover is attached to a collar that is removably mounted on said feed horn.

12. The method of claim 11, wherein said opening of said feed horn is circular.

13. The method of claim 12, wherein said aperture cover comprises a sliding member which moves with respect to said collar allowing said aperture cover to cover any fraction of area of said opening of said feed horn when said collar and said aperture cover are placed over said opening of said feed horn.

14. The method of claim 12, wherein said aperture cover comprises a fixed aperture cover to cover a fixed fraction of area of said opening of said feed horn when said collar and said aperture cover are placed over said opening of said feed horn.

15. The method of claim 12, wherein the steps of placing said aperture cover over said opening of said feed horn and rotating said aperture cover about said feed horn are accomplished manually.

16. An apparatus for efficiently pointing a satellite receiver antenna dish, a satellite receiver having a satellite dish, a mount attached to the satellite dish, a feed horn, a low noise block radio frequency detector attached to said feed horn, microwave power amplifier, and a strut for attaching said feed horn and microwave power amplifier and said low noise block radio frequency detector to said satellite dish, and a rotation mechanism for moving said satellite dish, said feed horn, said low noise block radio frequency detector, said microwave power amplifier and said strut with respect to said mount to focus signals from a geo-synchronous satellite onto an opening of said feed horn, said apparatus comprising an aperture cover for covering a fraction of a cross-sectional area of said opening of said feed horn, said aperture cover blocking radiation that impinges on said feed horn opening.

17. The apparatus of claim 16, wherein said aperture cover comprises:

a collar that fits around said feed horn near said opening; and a piece of electromagnetic reflecting material slidably attached to said collar and partially covering said opening of said feed horn when said collar is placed on said feed horn.

18. The apparatus of claim 17, wherein said piece of electromagnetic reflecting material slides with respect to said collar allowing said aperture cover to cover any desired fraction of said cross-sectional area of said opening of said feed horn.

19. The apparatus of claim 16, wherein said aperture cover comprises:

a collar that fits around said feed horn near said opening; and a piece of electromagnetic reflecting material permanently attached to said collar and partially covering said opening of said feed horn when said collar is placed on said feed horn.

20. The apparatus of claim 16, wherein said satellite dish is essentially circular.

21. The apparatus of claim 20, wherein a cross section of said feed horn opening is essentially circular.

22. The apparatus of claim 16, wherein said satellite dish is essentially rectangular.

23. The apparatus of claim 22, wherein a cross section of said feed horn opening is essentially rectangular.

* * * * *